US005197919A

United States Patent [19]

Geib et al.

[11] Patent Number: 5,197,919

[45] Date of Patent: Mar. 30, 1993

[54] DISC-TYPE COIN SORTER WITH MOVABLE BEARING SURFACE

[75] Inventors: Joseph J. Geib, DesPlaines; Rasmussen M. James, Chicago, both of Ill.

[73] Assignee: Cummins-Allison Corporation, Mt. Prospect, Ill.

[21] Appl. No.: 719,518

[22] Filed: Jun. 21, 1991

[51] Int. Cl.[5] ..... G07D 3/00

[52] U.S. Cl. ..... 453/10; 453/57

[58] Field of Search ..... 453/6, 10, 32, 57

[56] References Cited

U.S. PATENT DOCUMENTS 3,757,805 9/1973 Puhahn et al. ..... 453/57

4,564,036 1/1986 Ristvedt ..... 453/32 X

FOREIGN PATENT DOCUMENTS 2012863 10/1971 Fed. Rep. of Germany ..... 453/10

*Primary Examiner*—F. J. Bartuska

*Attorney, Agent, or Firm*—Arnold, White & Durkee

[57] ABSTRACT

A disc-type coin sorter for sorting coin mixtures which include at least one coin denomination made of a soft metal such as aluminum, the sorter has a rotatable disc having a resilient top surface, a motor for rotating the disc, a stationary sorting head having a lower surface positioned over and closely adjacent to the upper surface of the disc and having an opening in the central region thereof for feeding coins between the opposed surfaces of the disc and sorting head, the lower surface of the sorting head being contoured to align the coins in a single file and single layer of coins, and then sorting the coins according to their respective sizes, the contoured lower surface having at least one region for pressing the soft-metal coins into the resilient pad, and at least one rotatable bearing member mounted in the pressing region of the sorting head for engaging soft-metal coins passing thereunder so as to provide a rotatable bearing surface which eliminates or reduces galling of the soft metal of the coin on that region of the sorting head.

7 Claims, 4 Drawing Sheets

DISC-TYPE COIN SORTER WITH MOVABLE BEARING SURFACE

BACKGROUND OF THE INVENTION

1. Field of the Invention

The present invention relates generally to coin sorting devices and, more particularly, to coin sorters of the type which use a resilient rotating disc and a stationary sorting head for sorting coins of mixed denominations. The coin sorter of this invention is particularly useful with coin sets which included at least one coin denomination made of a soft metal such as aluminum, and/or in which the variation in thickness among the various coin denominations is very small.

2. Background Information

Although disc-type coin sorters with resilient disc have been used for a number of years, problems are still encountered in applying this technology to certain coin sets. For example, if the coin set includes one or more coin denominations made of a soft metal such as aluminum, the soft-metal coins tend to gall on the portions of the sorting head where the coins are pressed firmly into the surface of the resilient disc. The resulting metal deposited on the sorting head from such galling can result in the mis-sorting of coins.

SUMMARY OF THE INVENTION

It is a primary object of the present invention to provide an improved disc-type coin sorter which reduces or eliminates galling of coins made of a soft metal such as aluminum.

It is another important object of this invention to provide an improved disc-type coin sorter which effectively aligns and sorts coin sets in which the coins vary only slightly in thickness.

Still another object is to provide an improved disc-type coin sorter of the foregoing type which is extremely simple to manufacture, thereby reducing the cost of manufacture.

Other objects and advantages of the invention will be apparent from the following detailed description and the accompanying drawings.

In accordance with the present invention, the foregoing objectives are realized by providing a disc-type coin sorter for sorting coin mixtures which include at least one coin denomination made of a soft metal such as aluminum, the sorter has a rotatable disc having a resilient top surface, means for rotating the disc, a stationary sorting head having a lower surface positioned over and closely adjacent to the upper surface of the disc and having an opening in the central region thereof for feeding coins between the opposed surfaces of the disc and sorting head, the lower surface of the sorting head being contoured to align the coins in a single file and single layer of coins, and then sorting the coins according to their respective sizes, the contoured lower surface having at least one region for pressing the soft-metal coins into the resilient pad, and at least one rotatable bearing member mounted in the pressing region of the sorting head for engaging soft-metal coins passing thereunder so as to provide a rotatable bearing surface which eliminates or reduces galling of the soft metal of the coin on that region of the sorting head.

DESCRIPTION OF THE PREFERRED EMBODIMENTS

Figure 1:
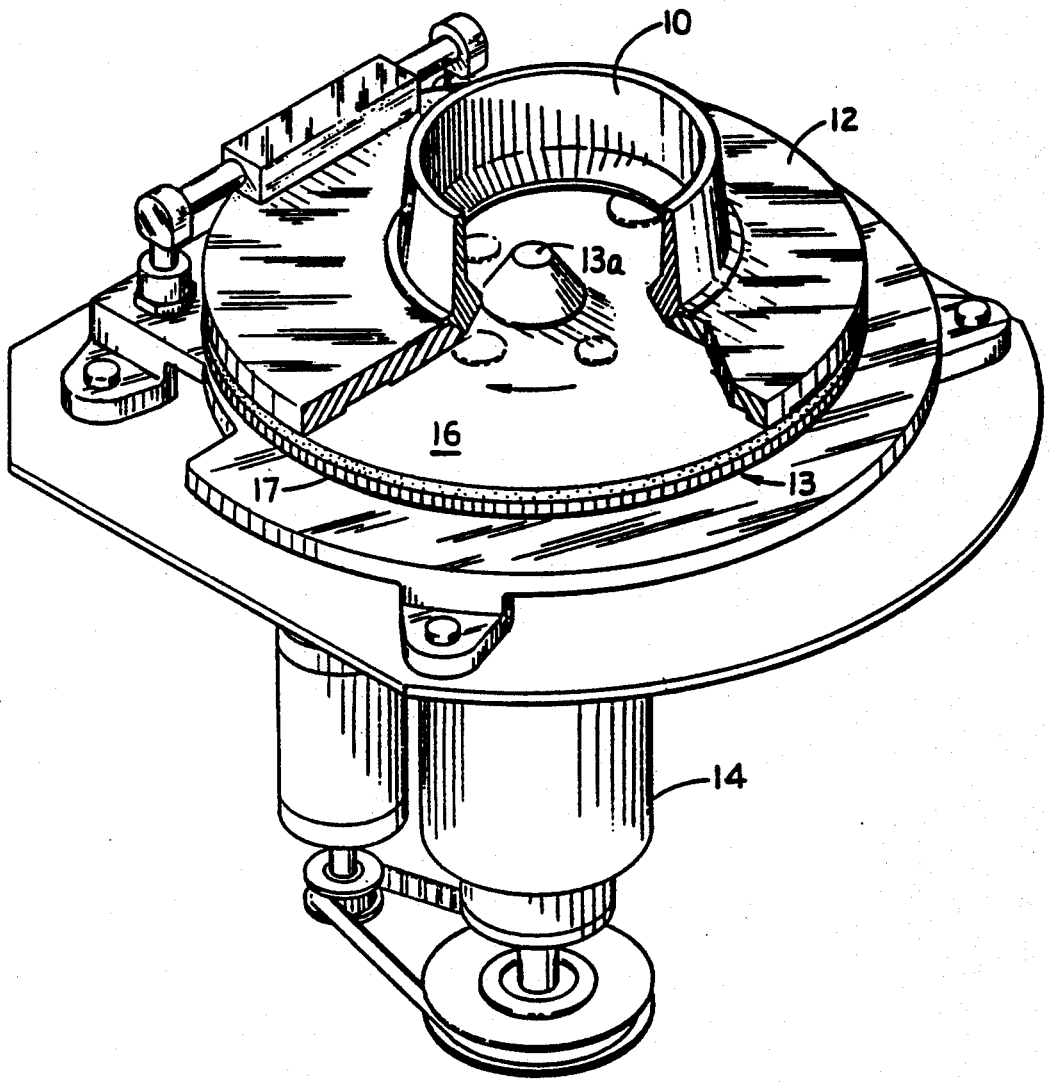
FIG. 1 is perspective view of a coin sorter embodying the present invention, with portions thereof broken away to show internal structure.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Turning now to the drawings and referring first to FIG. 1, a hopper 10 receives coins of mixed denominations and feeds them through a feed opening 11 in an annular sorting head or guide plate 12. As the coins pass through the feed opening 11, they are deposited on the top surface of a rotatable disc 13. This disc 13 is mounted for rotation on a stub shaft (not shown) and driven by an electric motor 14 mounted to a base plate 15. The disc 13 comprises a resilient pad 16 bonded to the top surface of a solid metal disc 17.

As the disc 13 is rotated, the coins deposited on the top surface thereof tend to slide outwardly over the surface of the pad due to centrifugal force. As the coins move outwardly, those coins which are lying flat on the pad enter the gap between the pad surface and the sorting head 12 because the underside of the inner periphery of this plate is spaced above the pad 16 by a distance, which is approximately the same as, or slightly less than, the thickness of the thinnest coin. As further described below, the coins are sorted into their respective denominations, and the coins for each denomination issue from a respective exit slot, such as the slots 20, 21, 22, 23, 24 and 25. The particular embodiment illustrated in FIG. 2 was specifically designed for handling six Japanese coins.

In general, the coins for any given currency are sorted by the variation in diameter for the various denominations. Prior to sorting, the coins are manipulated between the sorting head and the rotating disc to queue the coins into a single-file, single-layer stream of coins. The outer edges of all the coins in this stream of coins are normally aligned at a common radius so that the inner edges of the coins can be engaged to discriminate among coins of different diameters, directing the coins to the exit slots for the respective denominations.

Figure 2:
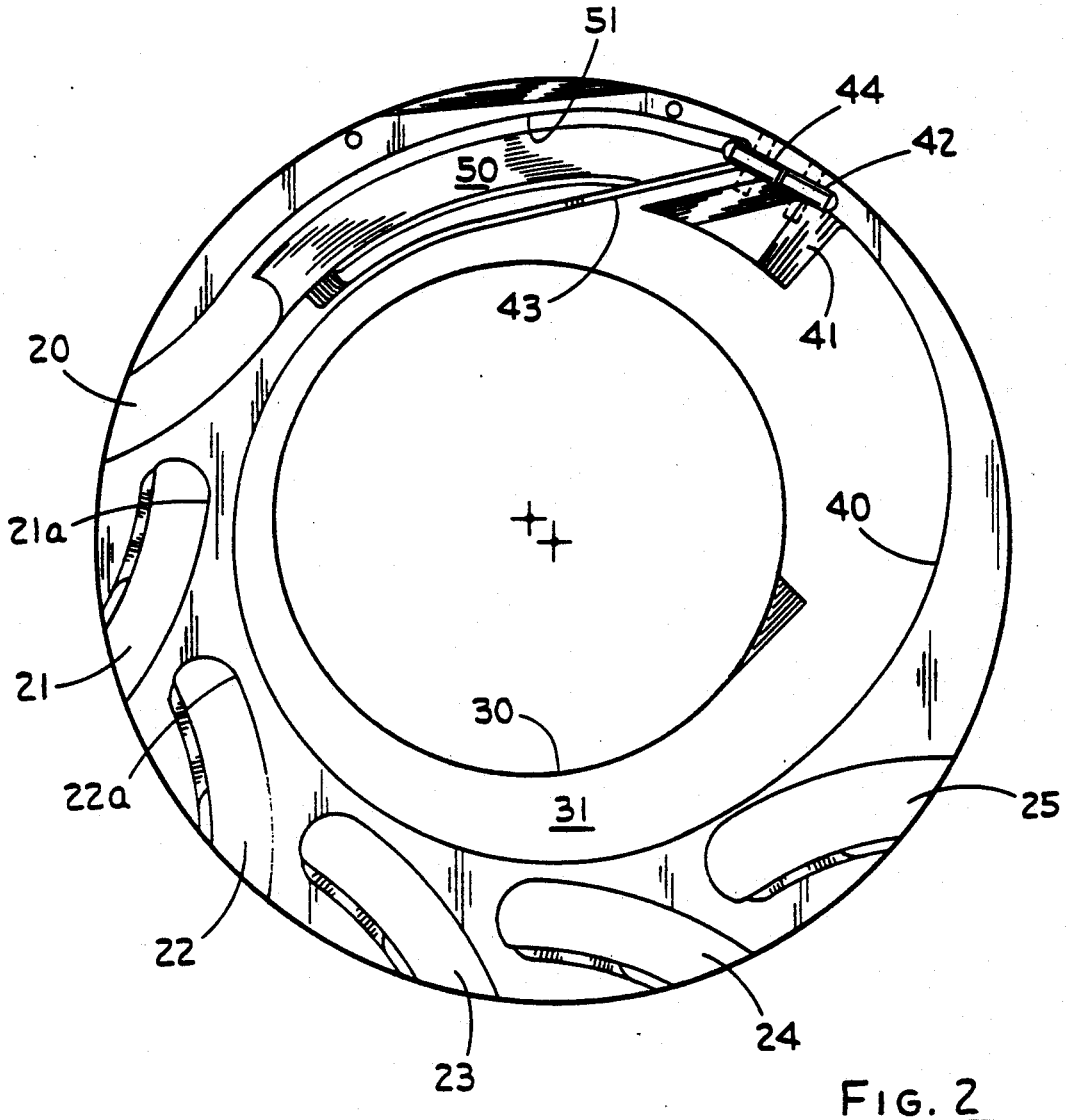
FIG. 2 is an enlarged bottom plan view of the sorting head or guide plate in the coin sorter of FIG. 1.
Figure 3:
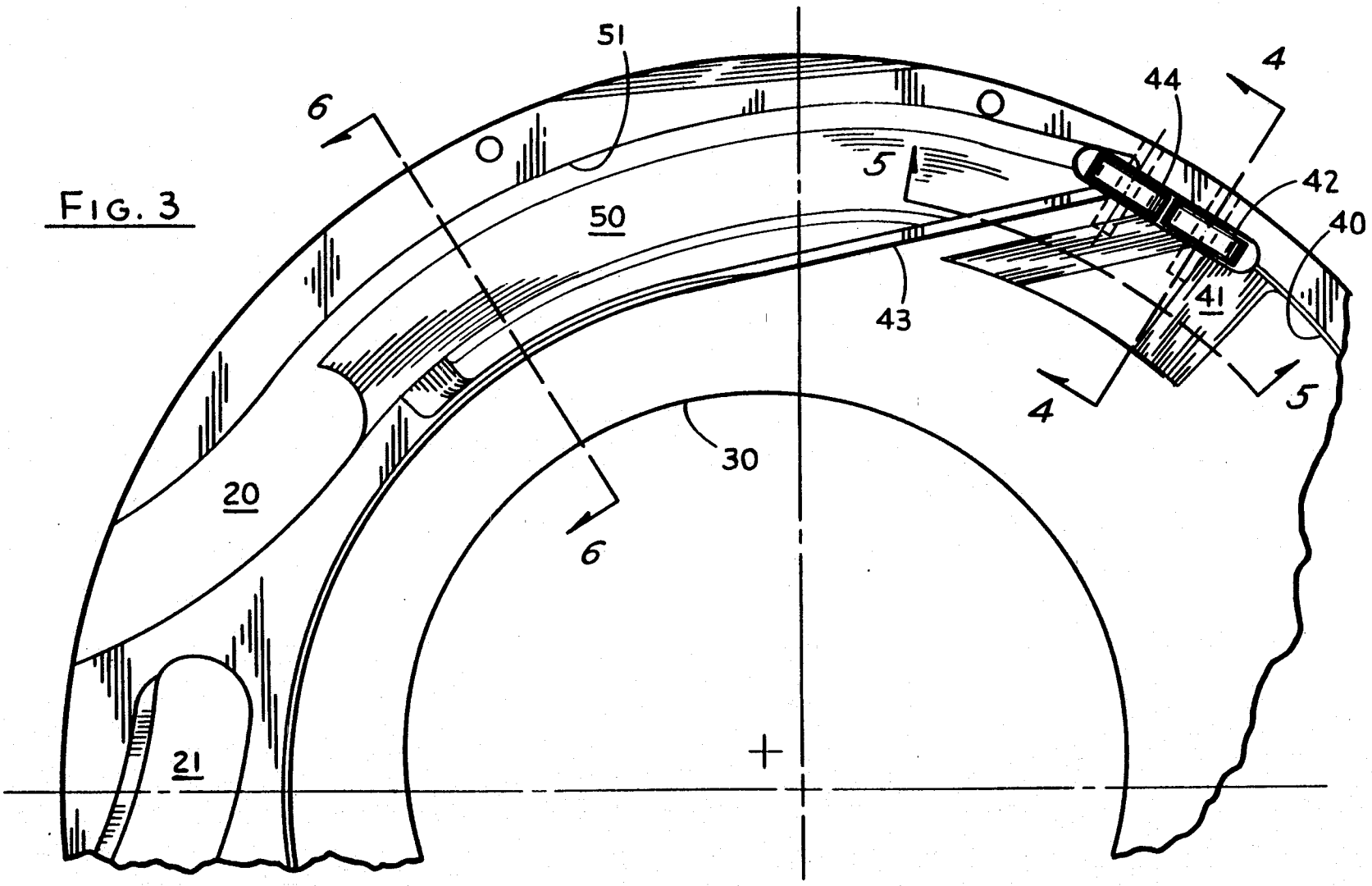
FIG. 3 is an enlargement of the top portion of FIG. 2.
Figure 4:
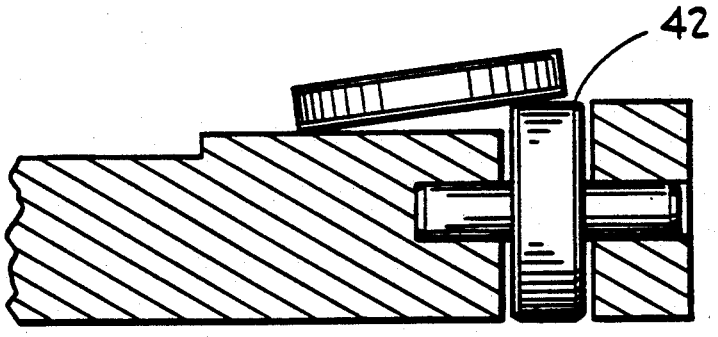
FIG. 4 is a section taken generally along line 4—4 in FIG. 3, with the addition of a coin in full elevation.
Figure 5:
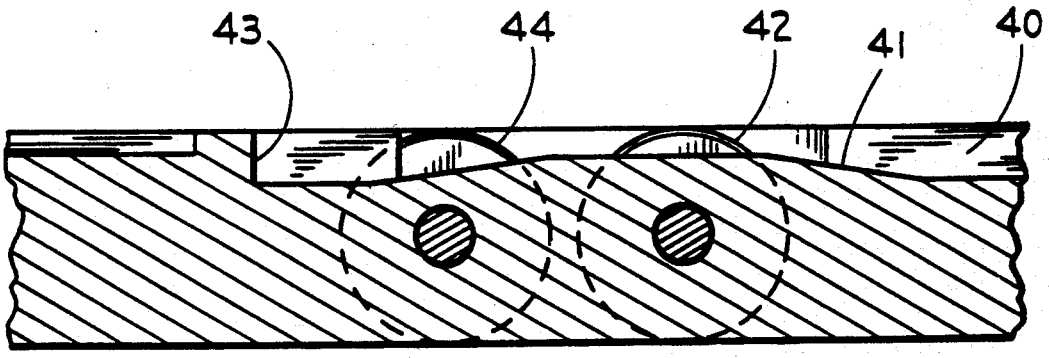
FIG. 5 is a section taken generally along line 5—5 in FIG. 3.

Turning now to FIG. 2, there is shown a bottom view of the preferred sorting head 12 including various channels and other means especially designed for high-speed sorting with positive control of the coins. It should be kept in mind that the circulation of the coins, which is clockwise in FIG. 1, appears counterclockwise in FIG.

2 because FIG. 2 is a bottom view. The various means operating upon the coins include an entry region extending around the entire inner periphery 30 of the sorting head, a queuing region which includes a spiral wall 40, a gaging channel 50, and the exit channels 20–25 for the six different coin denominations.

Considering first the entry region, the coins deposited on the rotating disc 13 directly beneath the feed opening 11 are carried under the inner periphery 30 of the sorting head into an annular recess 31 extending around the entire circumference of the sorting head. Coins can move radially into the recess 31, which is spaced above the top surface of the pad 16 by a distance which is about the same as the thickness of the thickest denomination of coin.

The feeding of coins into the entry recess 31 is enhanced by offsetting the center of the feed opening 11 from the center of rotation of the disc 13. By offsetting the center of the coin-feed opening from the center of rotation of the disc, many of the coins drop onto the rotating disc in an area which is already at a greater radius from the center of rotation of the disc than is possible with a concentric feed opening. Consequently, such coins begin their transport by the rotating disc at a higher linear velocity than would otherwise be possible, and by the time they first enter into the area under the sorting head, these coins are already moving at a linear velocity which carries them quickly to the outwardly spiralling wall 40 leading to the sorting area. Because of this greater initial linear velocity of the coins, they pass beneath the sorting head much more easily and rapidly, thereby further increasing the coin-throughput rate. Also, coins can be carried into the entry recess 31 by the circumferential movement of the coin on the surface of the rotating disc.

A further advantage of the eccentric feed opening is that it increases the churning of coins as they are fed into the feed opening through the hopper 10, thereby further increasing the rate at which coins are fed from the feed opening into the space between the sorting head and the rotating disc. It will be noted that the center of the rotating disc normally carries a small conical diverter 13*a* which directs coins toward the wall of the feed opening as the coins pass downwardly from the hopper 10 through the feed opening 11. With the eccentric feed opening the radial dimension of the annular space traversed by the rotating coins between the conical diverter 13*a* and the wall 30 of the feed opening 11 is constantly changing from a minimum dimension to a maximum dimension. Consequently, as coins move from the region of maximum radial dimension to the region of minimum radial dimension, the coins are driven against each other, thereby providing enhanced churning action. One of the specific advantages of this churning is that coins which tend to stand on edge against the wall of the feed opening are knocked down so that they lie flat on the resilient surface of the rotating disc, which is the orientation required for coins to enter into the narrow gap between the sorting head and the rotating disc.

Outward movement of coins within the recess 31 is terminated when they engage the outer wall 40, though the coins continue to be moved circumferentially along the wall 40 by the rotational movement of the disc 13. The outer wall 32 of the recess 31 extends downwardly to the lowermost surface of the sorting head 12, which is preferably spaced from the top surface of the pad 16 by a distance, e.g., 0.005 inch, which is less than the thickness of the thinnest coin.

At the end of the spiral wall 40, i.e., at the point where the spiral wall reaches its maximum diameter, the coins engage a ramp 41 which presses the coins downwardly into the resilient surface of the rotating disc. Those coins which are either against the wall 40, or close to the wall, engage a roller bearing 42 near the lower end of the ramp 41. The lower portion of the roller bearing 42 extends below the lower edge of the ramp 41, and thus continues to press the engaged coins deeper into the resilient surface of the rotating disc. If a coin is not sufficiently close to the wall 40 to be engaged by the roller bearing 42, then the coin bypasses the roller bearing and engages a wall 43 which guides the coin back into the entry recess 31 for recirculation. Coins which engage the roller bearing 42 pass beneath this roller bearing onto a second roller bearing 44 and then into the gaging channel 50.

Both the roller bearings 42 and 44 are journaled within the stationary sorting head so that the surfaces of the roller bearings can move with the coins by rotating as the coins ride over the roller bearings. That is, the surfaces of the roller bearings 42 and 44 which are in engagement with a coin are rotated by the frictional engagement with the moving coin, so that the coin surface does not rub against the primary bearing surface in this high-pressure region of the sorting head. Consequently, galling of the soft-metal coins is reduced, or even eliminated, by the use of the roller bearings in this region of the sorting head.

It can occur that coins which engage the roller bearings 42 and 44 can be slightly shifted in their radial position. To correct this, coins which pass the recycling wall 43 enter the gaging channel 50 which allows the coins to be realigned against the radially outer wall 51. The channel 50 and wall 51 allow the coins in the sorting path an opportunity to realign their outer edges at the radial position required for correct sorting. To ensure that every coin engages the wall 51, the radius of the wall 51 from the center of the disc is gradually decreased along the length of the channel 50.

Figure 6:
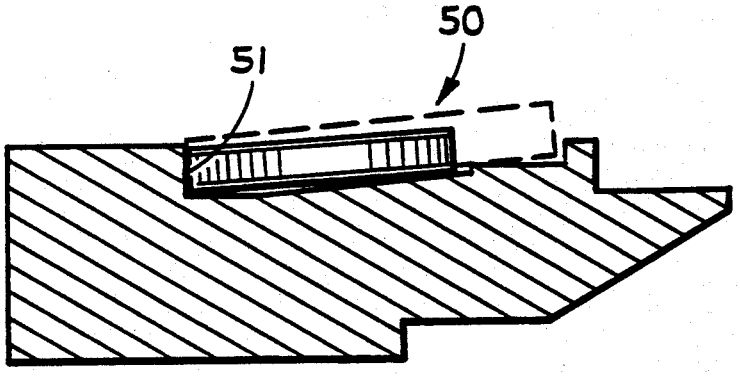
FIG. 6 is a section taken generally along line 6—6 in FIG. 3, with the addition of a coin shown in full elevation, and a second, larger coin shown in broken lines.

As can be seen most clearly in FIG. 6, the outer portion of the gaging channel 50 is at least as deep as the thickness of the soft-metal coin, so that at least a major portion of that coin is not pressed against the sorting head, or at least is pressed against the head with only slight pressure so as to avoid galling. In the particular embodiment illustrated, the outer portion of the gaging channel is tapered slightly so that the outer portion of the soft-metal coin (illustrated in FIG. 6) does not engage the sorting head at all, and the inner portion of the coin rides only lightly on the sorting head. The radially inner portion of the gaging channel 50 has a shallower depth so as to maintain the thinnest coins under control by pressing them into the resilient pad.

Beyond the gaging channel 50, the sorting head 12 forms the series of exit channels 20–25 spaced circumferentially around the outer periphery of the sorting head, with the innermost edges of successive channels located progressively farther away from the common radial location of the outer edges of all the coins for receiving and ejecting coins in order of increasing diameter. The first exit channel 20 receives the smallest coin, which in the Japanese coin set is the coin made of aluminum. This exit channel 20 is formed as an extension of the gaging channel 60, and thus the aluminum coin is guided directly from the gaging channel 60 into the exit channel 20 without passing through another high-pressure region. The exit channel 20 is also at least as wide as the diameter of the aluminum coin so that this coin is also not subjected to any significant pressure while it is being discharged through the exit channel 20.

The width of each of the exit channels 21–25 is preferably smaller than the diameter of the coin to be received and ejected by that particular recess, so that the surface of the sorting head adjacent the radially outer edge of each exit channel presses the outer portions of the coins received by that channel into the resilient pad 16, thereby tilting the inner edges of those coins upwardly into the channel. The exit channel extend outwardly to the periphery of the sorting head so that the inner edges of these channels guide the tilted coins outwardly and eventually eject those coins from between the sorting head 12 and the resilient pad 16.

The innermost edges of the exit channels 21–25 are positioned so that the inner edge of a coin of only one particular denomination can enter each channel; the coins of all other remaining denominations extend inwardly beyond the innermost edge of that particular channel so that the inner edges of those coins cannot enter the channel.

For example, the exit channel 21 is intended to discharge only Japanese 50-yen coins, and thus the innermost edge 21*a* of this channel is located at a radius that is spaced inwardly from the final radius of the gaging wall 51 by a distance that is only slightly greater than the diameter of a 50-yen coin. Consequently, only 50-yen coins can enter the channel 21. Because the outer edges of all denominations of coins are located at the same radial position when they leave the gaging channel 50, the inner edges of all denominations other than the 50-yen coin extend inwardly beyond the innermost edge of the exit channel 21, thereby preventing these coins from entering that particular channel.

At exit channel 22, the inner edges of only the Japanese 5-yen coins are located close enough to the periphery of the sorting head 12 to enter the exit channel. The inner edges of all the larger coins extend inwardly beyond the innermost edge 22*a* of the channel 22 so that they remain gripped between the sorting head 12 and the resilient pad 16. Consequently, all the coins except the 5-yen coins continue to be rotated past the exit channel 22.

Similarly, only Japanese 100-yen coins enter the channel 23, only Japanese 10-yen coins enter the channel 24, and only Japanese 500-yen coins enter the channel 25. The entire Japanese coin set has a thickness range of 0.060 to 0.072 inch.

We claim

1. A disc-type coin sorter for sorting coin mixtures which include at least one coin denomination made of a soft metal such as as aluminum, said sorter comprising:

a rotatable disc having a resilient top surface, means for rotating said disc, a stationary head having a lower surface positioned over and closely adjacent to the upper surface of said disc and having an opening in said central region thereof for feeding coins between the opposed surfaces of said disc and sorting head, the lower surface of said sorting head being contoured to align said coins in a single file and single layer of coins, said contoured lower surface having at least one region located close enough to said resilient top surface to press said soft-metal coins into said resilient surface, whereby said resilient surface urges said soft-metal coins upwardly against said sorting head, said pressing region including a gaging recess for aligning the edges of all the single-file coins at a common radius, and at least one rotatable non-driven bearing member mounted at the upstream end of said pressing region of said sorting head for engaging soft-metal coins passing thereunder so as to provide a rotatable bearing surface which eliminates or reduces galling of the soft metal of the coin on that region of the sorting head.

2. The coin sorter of claim 1 wherein opening in the central region of said sorting head has a center that is offset from the center of rotation of said disc so that coins deposited on said disc at the side of the opening spaced farthest away from the center of said disc are carried under the sorting head by rotation of said disc.

3. The coin sorter of claim 1 wherein said rotatable bearing member comprises at least one roller bearing journaled in said sorting head, with the axis of rotation extending transversely to the direction of coin movement on the surface of said rotatable disc.

4. The coin sorter of claim 1 wherein the lower surface of said sorting head includes recycle means at the end of the alignment region for directing coins that have not been properly aligned back toward the central region of the sorting head, and said rotatable bearing member is located at the outer edge of said recycle channel.

5. The coin sorter of claim 1 wherein said rotatable bearing member extends below the adjacent inner surface of said sorting head so that the coins are tilted as they pass over said bearing member.

6. The coin sorter of claim 1 wherein at least the outer region of said gaging channel is at least as deep as the thickness of the soft-metal coins so that at least the outer portions of those coins are not pressed into said resilient surface.

7. The coin sorter of claim 1 wherein the portion of said lower surface of said sorting head under which said soft-metal coins pass before they reach said bearing member is spaced far enough from said resilient top surface to avoid pressing said soft-metal coins into said resilient surface.

* * * * *